US005245957A

United States Patent [19]

Bornstein et al.

[11] Patent Number: 5,245,957

[45] Date of Patent: Sep. 21, 1993

[54] SPRING ASSIST SYSTEM FOR INTERNAL COMBUSTION ENGINE VALVES

[75] Inventors: Irvin Bornstein; Thomas B. Middlebrooks; Scott M. Eddy; Charles E. Benedict, all of Tallahassee, Fla.

[73] Assignee: Bornstein Motor Company, Inc., Tallahassee, Fla.

[21] Appl. No.: 13,731

[22] Filed: Feb. 4, 1993

[51] Int. Cl.[5] ..... F01L 1/30

[52] U.S. Cl. ..... 123/90.26; 123/90.65

[58] Field of Search ..... 123/90.24, 90.26, 90.65

[56] References Cited

U.S. PATENT DOCUMENTS

| | | | |
|---|---|---|---|
| 1,789,209 | 1/1931 | Asbury | 123/90.65 |
| 2,641,236 | 6/1953 | Mansfield | 123/90.24 |
| 2,689,557 | 9/1954 | Taylor | 123/90.65 |
| 3,066,659 | 12/1962 | Colton | 123/90.65 |
| 3,289,658 | 12/1966 | Surovek, Sr. | 123/90.65 |
| 3,556,062 | 1/1971 | Shermeister | 123/90.65 |
| 4,380,216 | 4/1983 | Kandler et al. | 123/90.65 |
| 4,457,268 | 7/1984 | Jones | 123/90.24 |

*Primary Examiner*—Willis R. Wolfe
*Assistant Examiner*—Erick Solis
*Attorney, Agent, or Firm*—Dowell & Dowell

[57] ABSTRACT

A spring assembly for positively urging inlet and exhaust valves of a internal combustion engine into both open and closed positioned wherein the spring assembly includes an engaging member which is biased alternatively in both directions relative to the elongated axis of the stem of each valve by a spring member which is oriented generally perpendicular with respect to the valve stem and which engaging member is engagable within a groove or detent formed in the valve stem.

14 Claims, 2 Drawing Sheets

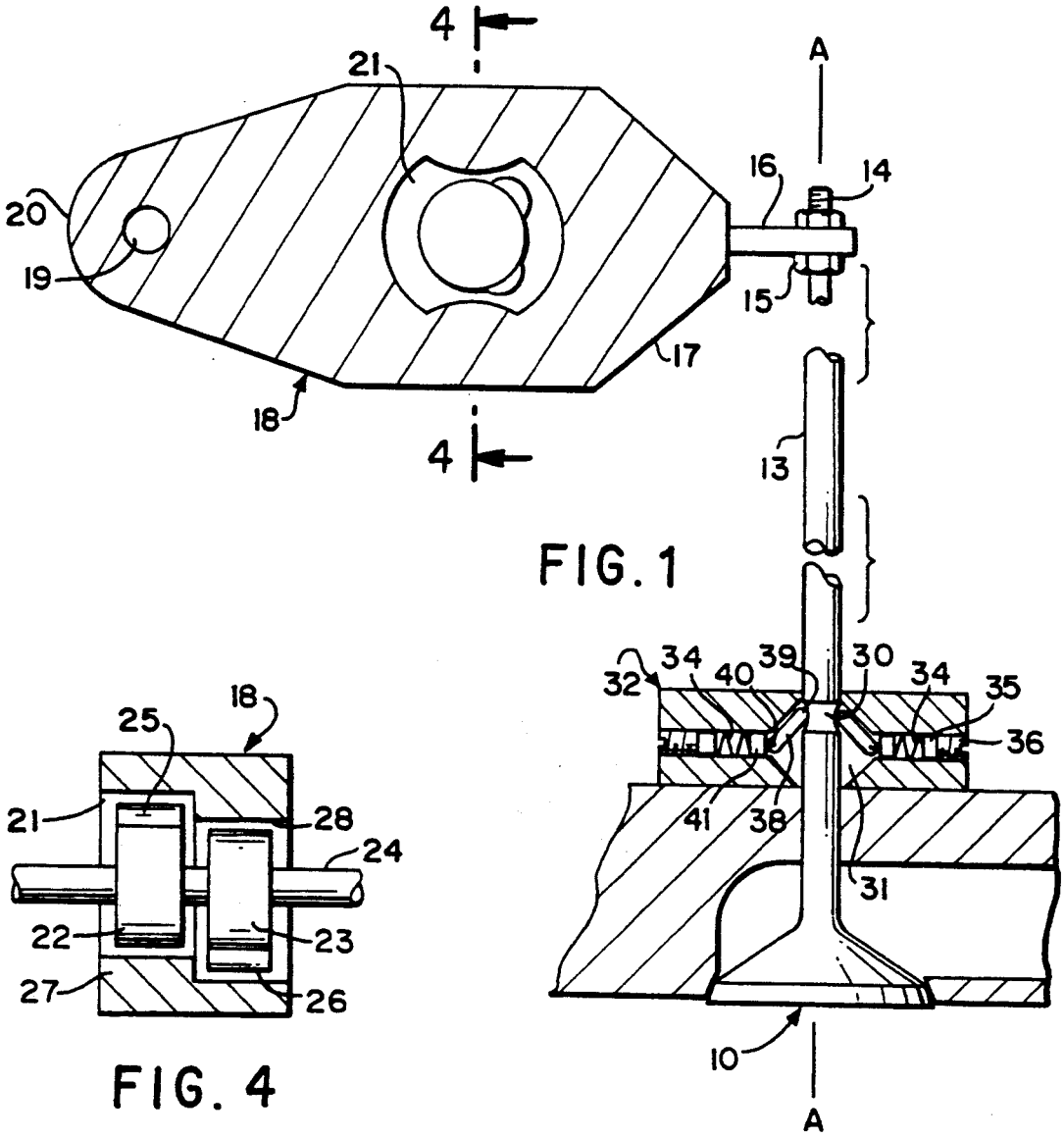
FIG. 1
FIG. 4
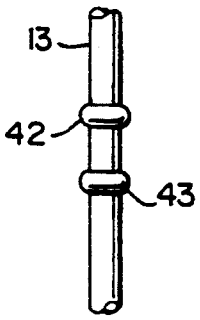
FIG. 6
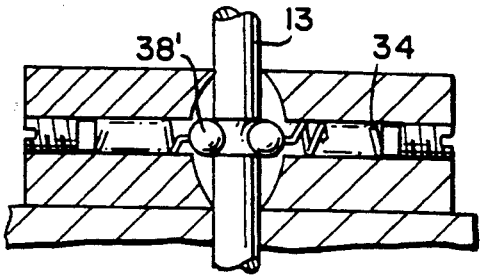
FIG. 5

SPRING ASSIST SYSTEM FOR INTERNAL COMBUSTION ENGINE VALVES

BACKGROUND OF THE INVENTION

1. Field of the Invention

This invention is generally directed to systems for controlling the intake and exhaust valves of internal combustion engines and more specifically to a spring assist assembly which functions to positively bias the valves into either an open or closed position once the valves have passed a generally dead center position with regard to the spring assist system. The force provided by the spring assist system may be varied to thereby facilitate adjusting of the timing of the opening and closing of the valves. The spring assemblies are designed to assist in the operation of the intake and exhaust valves in an engine wherein the valves are controlled by a split lobe cam shaft arrangement utilizing a follower which is mounted so as to be engagable with the split lobes to open or close the valves depending upon the position of the cam lobes relative to the follower and wherein each cam follower is resiliently connected to the stem of a respective valve.

2. History of the Related Art

In order to increase the efficiency of the intake and exhaust valves of internal combustion engines, it has been proposed to utilize various biasing techniques for assisting the valves in moving to a closed position. Such a positive biasing of the valves during engine operation is important especially in the field of high speed internal combustion engines. In addition to operating to facilitate and positively control the closure of the valves, the biasing of the valves also stresses the valves' stems relative to their connection with tracking members associated with timing gears or cams which control the opening and closing of the valves.

Some examples of prior art valve biasing mechanisms are disclosed in U.S. Pat. Nos. 1,789,209 to Ausbury, 2,689,557 to Taylor, 3,066,659 to Colton, 3,289,658 to Surovek, Sr. and 3,556,062 to Shermeister.

SUMMARY OF THE INVENTION

This invention is directed to a spring assembly for positively biasing the intake and exhaust valves of an internal combustion engine to both an open and closed position relative to the engine cylinders and wherein each valve stem is provided with a detent. Each valve stem is reciprocated by being engaged through a spring member to a cam follower which is acted upon by the intake and exhaust lobes mounted to a cam shaft controlled by the engine crankshaft. The spring assembly includes a housing having one or more bores oriented generally perpendicular with respect to the valve stem in which springs are mounted. Each spring acts on an engaging member having its free end seated within the detent formed in the valve stem in such a manner that as the valve stem is reciprocated, the engaging member will be forced inwardly of the bore thereby compressing the spring element as the valve stem approaches an intermediate stroke position. After passing generally perpendicularly relative to the bore or bores in the spring assembly, the springs will urge the engaging member either toward a valve open position or a valve closing position along the axis of the valve stem.

In the preferred embodiment, two or more valve stem engaging members are resiliently urged into contact with the detent formed in the valve stem. In addition, the valve stem detent may be formed around the circumference of the valve stem or may be formed by creating a pair of spaced ribs which define an artificial detent around the valve stem.

The biasing force created by the spring assembly may be adjusted by providing adjusting screws for selecting compressing springs mounted within the bores to thereby adjust the thrust force of the springs towards the valve open and closed positions.

It is the primary object of the present invention to provide for the positive biasing of the valves of an internal combustion engine to both the open and closed positions once the valves have been moved beyond an intermediate position by control of cam followers associated with the crankshaft of the engine.

It is another object of the present invention to provide means for tensioning the valve stems of an internal combustion engine relative to cam followers associated with a timing cam shaft to thereby increase the responsive movement of the valve stems to the cam follower.

It is yet another object of the present invention to provide means for positively biasing the intake and exhaust valves of an internal combustion engine to a fully closed or fully open position once the valve stem associated with each valve so as to more accurately control the operation of the valve.

It is yet a further object of the present invention to provide a spring assembly for biasing the intake and exhaust valves of an internal combustion engine to both an open and closed position wherein the biasing force may be selectively adjusted so as to facilitate accurate control of the opening and closing of the valves.

It is also an object of the present invention to provide a spring assembly for biasing the intake and exhaust valves of an internal combustion engine to open and closed positions utilizing the same springs to provide bias the valves to both open and closed positions.

BRIEF DESCRIPTION OF THE DRAWINGS

FIG. 1 is a cross-sectional illustrational view showing the spring assembly of the present invention utilized in conjunction with a valve and valve stem which are controlled by a cam follower mounted in surrounding relationship to the opening and closing lobes of a timing cam shaft controlled by the engine crankshaft (not shown) showing the valve in an fully closed position.

FIG. 4 is a cross-sectional view taken along lines 4—4 of FIG. 1.

FIG. 5 is a partial cross-sectional view showing a second embodiment of a spring assembly in accordance with the teachings of the present invention.

FIG. 6 is a partial plan view of an alternate embodiment for the valve stems of the present invention.

DESCRIPTION OF THE PREFERRED EMBODIMENTS

Figure 2:
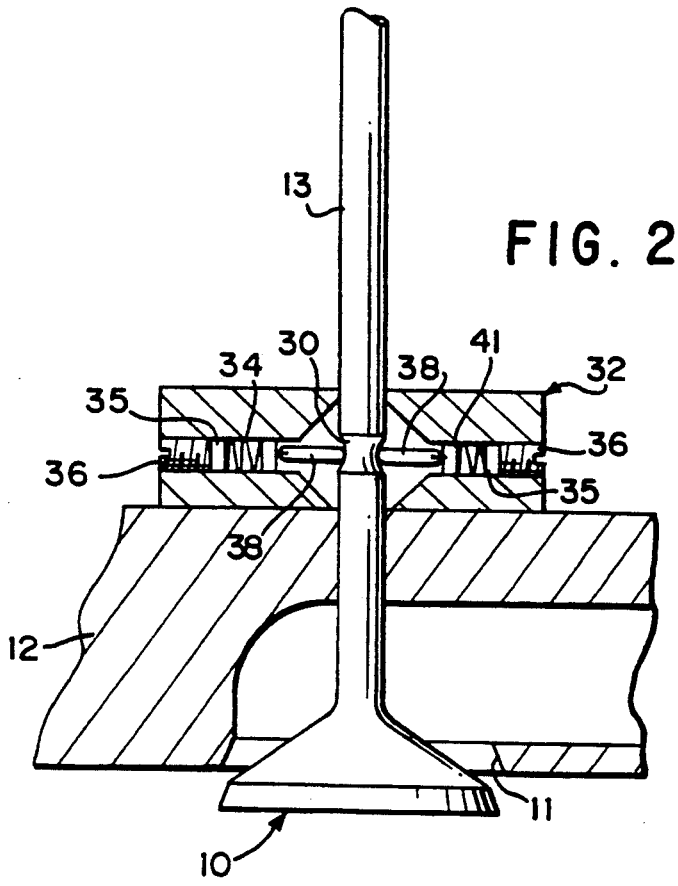
FIG. 2 is a partial cross-sectional illustrational view of the spring assembly shown in FIG. 1 showing the valve stem in an intermediate or neutral position between a valve closed and valve open position.

With continued reference to the drawings, the present invention is directed to means for positively biasing a valve 10 relative to a valve seat 11 which is formed in the head 12 of an engine block of above a cylinder (not shown). For purposes of the present invention only one valve will be shown. It should be noted that the spring assembly of the present invention may be utilized with both the intake and exhaust valves associated with each of the pistons of an internal combustion engine.

Each valve includes a valve stem 13 having an upper end portion which is threaded as shown at 14 so as to be engagable by a jam or lock nut 15. The lock nut 15 also engages one end of a spring 16 which is secured at one end 17 of a cam follower 18. The cam follower 18 is pivoted about a support shaft 19 adjacent to the other end 20 thereof. The cam follower 18 includes a central opening 21 in which are located the opening and closing cams 22 and 23 which are mounted to a cam shaft 24. The cams 22 and 23 may be fixed or adjustable mounted to the cam shaft 24. By allowing adjustment of the cams relative to the cam shaft the intake and exhaust timing created by the rotation of the cams 22 and 23 and their action on the cam follower and the valve 10 is selectively altered. The cam shaft is generally driven at some percentage of the engine speed by timing gears or other mechanisms which are meshed with gears mounted to the engine crankshaft (not shown).

As shown in FIG. 4, each cam 22 and 23 includes an associated lobe 25 and 26 which are respectively engagable with offset lobes 27 and 28 which extend inwardly of the opening 21 in the cam follower 18. In this manner when the cam lobe 25 of the exhaust opening cam 22 engages the internal cam lobe 27 of the cam follower, the cam follower is driven downwardly about the shaft 19 thereby driving the valve stem 13 and valve 10 into an open relationship with respect to the valve seat 11. In a like manner, the lobe 26 associated with the closing intake cam 23 is selectively engagable with the internal lobe 28 of the cam follower when the lobe 26 is in an upper position thereby pivoting the cam follower about the shaft 19 and raising the valve stem thereby closing the valve 10 against the valve seat 11.

Figure 3:
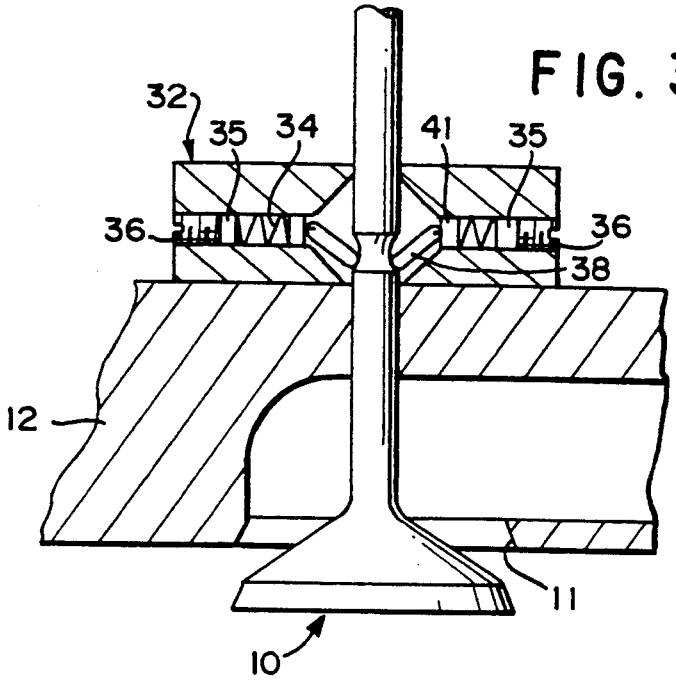
FIG. 3 is a partial cross-sectional illustrational view of the spring assembly shown in FIG. 1 except showing the valve in a fully open position.

As previously discussed, the spring assembly of the present invention is designed to positively bias the valve to an open or closed position once the internal lobes of the cam followers are engaged by either the opening or closing cams 22 and 23. In order to provide the positive bias, the valve stem 13 is provided with a recess or detent 30 which extends around the circumference thereof. The valve stem 13 is moveable within an opening 31 provided with the spring assembly housing 32 in such a manner that the detent 30 remains within the opening 31 as the valve stem is moved from a valve open to a valve closed position, as shown in FIGS. 1 and 3, respectively.

Interiorly of the spring assembly housing 32 are one or more bores 33 in which springs 34 are selectively retained. In the preferred embodiment, two opposing bores 33 are provided within the spring assembly housing however, in some embodiments, a single or three or more such bores and related springs may be utilized and be within the teachings of the present invention.

At the outer end of each spring is a sleeve 35 which is selectively engagable by an adjustable set screw 36 which is threadingly engaged within the outer portion of the bores 33. The outer portion of the bores are selectively threaded so as to receive the set screws 36. In this manner the set screws may be utilized to selectively adjust the compression of the springs 34.

The innermost ends of the springs are connected to levers 38 having outer end portions 39 which are seated within the detent 30 of the associated valve stem 13 and inner ends 40 which are pivotably secured to sleeves 41 secured to the innermost end of the springs 34.

The bores 33 are oriented generally perpendicularly with respect to an elongated axis A—A of the valve stem and thus the force of the springs 33 is directed generally perpendicularly with respect to the axis of the valve stem when the valve is in the position shown in FIG. 2. In this manner the springs will provide the same amount of force on the valve stem once the valve stem has passed the intermediate or dead center position shown in FIG. 2 to either raise the valve stem to fully seat the valve 10, as shown in FIG. 1, or to lower the valve stem to retain the valve open, as shown in FIG. 3. Therefore, the spring mechanisms work both in positively biasing the valve 10 to a fully closed and fully open position. As the valve stem moves from the valve closed position shown in FIG. 1 to the intermediate position shown in FIG. 2, the levers 38 will urge the springs 34 into compression within the bores 33. Thereafter, as the detent 30 passes the aligned position, shown in FIG. 2 relatively to the bores 33, toward a lower position shown in FIG. 3, the springs 34 will assist in positively biasing the valve to its fully opened position as shown in FIG. 3. This operation of the valve not only assures positive opening and closing of the valve once the cam follower has been acted upon by the lobes of the timing cams 22 and 23 but also assures that the spring connection between the cam follower and the valve stem remains positively biased at all times during the operation of the engine. This will assist in the proper timing and control of the valve between openings and closings regardless of engine speed.

In order to allow sufficient room for pivoting the levers 38 between the upper and lower positions as shown in FIGS. 1 and 3, the opening 31 in the housing 32 is shown as being somewhat V-shaped being tapered outwardly from the upper portion of the housing towards the bore 33 and then tapering inwardly towards the valve stem from the bore 33 to the lower portion of the housing. To provide additional guidance for the pivotable levers 38, followers may be secured to the intermediate portions thereof which followers could ride in grooves formed within the walls of the housing 32 on both sides of the opening 31 therethrough (this feature not being specifically shown in the drawing figures).

With reference to FIG. 5 of the drawing figures a second embodiment of valve stem engaging member is disclosed. In this embodiment, as opposed to levers 38, balls 38' are engaged by the spring elements 34. The balls 38' selectively engaged within the detent 30 of the valve stem 13. The balls 38' track within opposing tapered openings 31' formed on opposing sides of the valve stem.

With specific reference to FIG. 6, a modified valve stem is shown wherein the detent 30' is formed by providing a pair of annular extending ribs 42 and 43 which extend outwardly from the valve stem 13. It should be noted that other types of detents may be incorporated with the valve stem and fall within the teachings of the present invention.

In view of the foregoing, as the valve stem is raised and lowered to move the valve 10 to a fully closed or to a fully open position, as shown in FIGS. 1 and 3 respectively, once the valve stem passes the intermediate position shown in FIG. 2, the spring assembly will allow the springs 34 to urge the valve stem engaging members 38 or 38' to force the valve either upwardly to the fully closed position as shown in FIG. 1 or downwardly to a fully opened position as shown in FIG. 3. The operations of the spring elements may be adjusted by altering the compressive force applied thereto by the set screws 36. Because of the unique relationship of the spring assembly and the spring components relative to the detent in the valve stem equal force is applied to assist in fully opening or closing the valve member 10 during the operation of the engine. It should be noted that the spring assembly of the present invention may be utilized with other valve control or timing mechanisms in addition to the structure shown in FIGS. 1 through 3.

We claim:

1. A spring assist system for positively actuating the opening and closing of the valves of an internal combustion engine wherein each valve includes a valve stem having an elongated axis, the valve stem being drivingly connected to a control means so as to be moved reciprocally from a first position wherein the valve is closed against a valve seat to a second position wherein the valve is spaced from the valve seat, said spring assist system comprising, said valve stem having a detent means provided along it length, a detent engaging assembly mounted adjacent the valve stem and having a housing including an opening which is in open communication with said detent means as the valve stem moves between said first and second positions, a bore extending from said opening into said housing, a spring means mounted within said bore and biased generally perpendicular relative to the axis of the valve stem, a detent engaging element having a first portion engaged within said detent means of the valve stem and a second portion engaging said spring means whereby said spring means is compressed as the valve stem moves from either of the first and second position toward an intermediate position wherein the detent means is aligned with said bore and wherein said spring means thereafter positively assist in closing and opening said valve when the valve stem moves from said intermediate position to said first position and said second positions respectively.

2. The spring assist system of claim 1 including means for adjusting the biasing force on said spring means.

3. The spring assist system of claim 2 including at least two detent engaging assemblies each having a detent engaging element which is positively biased towards said detent means by a spring means, and a separate bore for each of said spring means.

4. The spring assist system of claim 1 including at least two detent engaging assemblies each having a detent engaging element which is positively biased towards said detent means by a spring means, and a separate bore for each of said spring means.

5. The spring assist system of claim 4 in which said detent engaging elements are levers having a first end engagable with said detent means of the valve stem and a second end pivotably secured to the spring means.

6. The spring assist system of claim 4 in which said detent engaging element includes a ball element.

7. The spring assist system of claim 4 in which the control means includes a valve timing mechanism including a cam follower means having first and second ends, said first end being pivotable about a support shaft, an opening within said cam follower and having a pair of offset lobes defined thereby, said timing mechanism further including a pair of cams each having a lobe for engaging one of the lobes of said cam follower, said cams being mounted to a cam shaft which is drivingly connected to an engine crankshaft, and connection means for connecting said cam follower to said valve stems.

8. The spring assist system of claim 5 in which said detent means includes an annular recess formed in said valve stem.

9. The spring assist system of claim 5 in which said detent means includes a pair of annular spaced ribs extending outwardly from the valve stem.

10. The spring assist system of claim 6 in which said detent means includes an annular recess formed in said valve stem.

11. The spring assist system of claim 6 in which said detent means includes a pair of annular spaced ribs extending outwardly from the valve stem.

12. The spring assist system of claim 1 in which said detent means includes an annular recess formed in said valve stem.

13. The spring assist system of claim 1 in which said detent means includes a pair of annular spaced ribs extending outwardly from the valve stem.

14. The spring assist system of claim 1 in which the control means includes a valve timing mechanism including a cam follower means having first and second ends, said first end being pivotable about a support shaft, an opening within said cam follower and having a pair of offset lobes defined thereby, said timing mechanism further including a pair of cams each having a lobe for engaging one of the lobes of said cam follower, said cams being mounted to a cam shaft which is drivingly connected to an engine crank shaft, and connection means for said cam follower to said valve.

* * * * *